US006962012B1

(12) United States Patent
Grimmett et al.

(10) Patent No.: US 6,962,012 B1
(45) Date of Patent: Nov. 8, 2005

(54) APPARATUS FOR GROOMING A BASEBALL INFIELD

(75) Inventors: Frankie D. Grimmett, Snyder, TX (US); George E. Page, Snyder, TX (US)

(73) Assignee: Diamond Drag, Inc., Snyder, TX (US)

( * ) Notice: Subject to any disclaimer, the term of this patent is extended or adjusted under 35 U.S.C. 154(b) by 0 days.

(21) Appl. No.: 10/622,665

(22) Filed: Jul. 18, 2003

Related U.S. Application Data

(60) Provisional application No. 60/397,387, filed on Jul. 18, 2002.

(51) Int. Cl.[7] ..... E02F 5/00
(52) U.S. Cl. ..... 37/381; 37/270
(58) Field of Search ..... 172/612, 189, 172/684, 684.5, 685; 37/381, 270, 383

(56) References Cited

U.S. PATENT DOCUMENTS

| | | | | |
|---|---|---|---|---|
| 1,167,112 | A * | 1/1916 | Robinson | 172/146 |
| 1,412,193 | A * | 4/1922 | Neudeck | 172/684.5 |
| 2,186,658 | A * | 1/1940 | Scheunemann | 172/799.5 |
| 2,311,639 | A * | 2/1943 | Click | 37/438 |
| 2,681,519 | A * | 6/1954 | Potter | 172/780 |
| 2,902,909 | A * | 9/1959 | Reissinger | 404/118 |
| 3,080,666 | A * | 3/1963 | Murray et al. | 172/780 |
| 3,711,608 | A | 11/1973 | Ancherico | |
| 3,814,190 | A * | 6/1974 | Wilson | 172/26.5 |
| 4,813,489 | A | 3/1989 | Just et al. | |
| 4,836,295 | A | 6/1989 | Estes | |
| 4,850,433 | A | 7/1989 | West | |
| 5,088,855 | A | 2/1992 | Giliberti | |
| 5,289,880 | A * | 3/1994 | Barto | 172/799.5 |
| 5,497,569 | A * | 3/1996 | Byman | 37/410 |
| 5,699,863 | A | 12/1997 | Figura | |
| 6,161,626 | A | 12/2000 | Lange et al. | |
| 2005/0006112 | A1 * | 1/2005 | Smith | 172/613 |

* cited by examiner

*Primary Examiner*—Meredith Petravick
(74) *Attorney, Agent, or Firm*—Bracewell & Giuliani LLP

(57) ABSTRACT

A grooming implement is used for athletic fields, particularly the infield of a ball field. A frame has a tongue on a forward end for attaching to a towing vehicle. The frame has a longitudinal beam and a transverse beam on a rearward end that is supported by a pair of wheels. A rake bar for raking the ground is mounted to the frame by a pair of arms. The arms are pivotally secured to opposite sides of the longitudinal beam forward of the wheels, so that rotating the brake bar arms about the pivot point swings the rake bar upward from a ground engaging position to a storage position beneath the frame. A broom bar for sweeping the ground is pivotally mounted to the transverse beam about a pivot point for dragging the broom bar behind the wheels while the broom bar is in a ground engaging position. Rotating the broom bar arm about the pivot point on the transverse beam places the broom bar in a storage position above the longitudinal beam.

17 Claims, 5 Drawing Sheets

APPARATUS FOR GROOMING A BASEBALL INFIELD

CROSS REFERENCE TO RELATED APPLICATION

This application claims priority to provisional application 60/397,387 filed Jul. 18, 2002

FIELD OF THE INVENTION

This invention relates in general to implements for earthwork, and in particular to a grooming apparatus for grooming athletic fields, such as an infield of a ball park.

BACKGROUND OF THE INVENTION

Baseball fields have an infield area extending around the bases that is smooth, soft dirt, free of any grass. The infield area has to be groomed to keep it the desired consistency. Grooming is required before games, and often the infield area is groomed during a game between innings.

A variety of implements are used to groom the infield area, some of which are pulled by hand, and others by a vehicle, such as a small tractor. These implements, which include rakes and brooms, are typically separate devices that must be stored and attached separately to a tractor. Sometimes adequate storage in the close vicinity of the ball field is not available, particularly with high school and college ball fields. Also, the grounds-keeping staff may be few in number, and the budgets to maintain the fields small.

SUMMARY OF THE INVENTION

In this invention, a grooming apparatus is provided that has a frame supported on a set of wheels at a rearward end. The frame has a tongue on a forward end for attachment to a towing vehicle, such as a small tractor. A rake bar for raking the ground of the athletic field is pivotally mounted below and transverse to the frame between the forward and rearward ends. The rake bar is movable between a ground engaging position and a storage position that is beneath the frame and elevated relative to the ground engaging position.

A broom bar is pivotally mounted to the rearward end of the frame for sweeping the ground. The broom is movable independently of the rake bar between a ground engaging position and a storage position. In the preferred embodiment, the broom rotates to an upper position above the wheels while in the storage position.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

Figure 1:
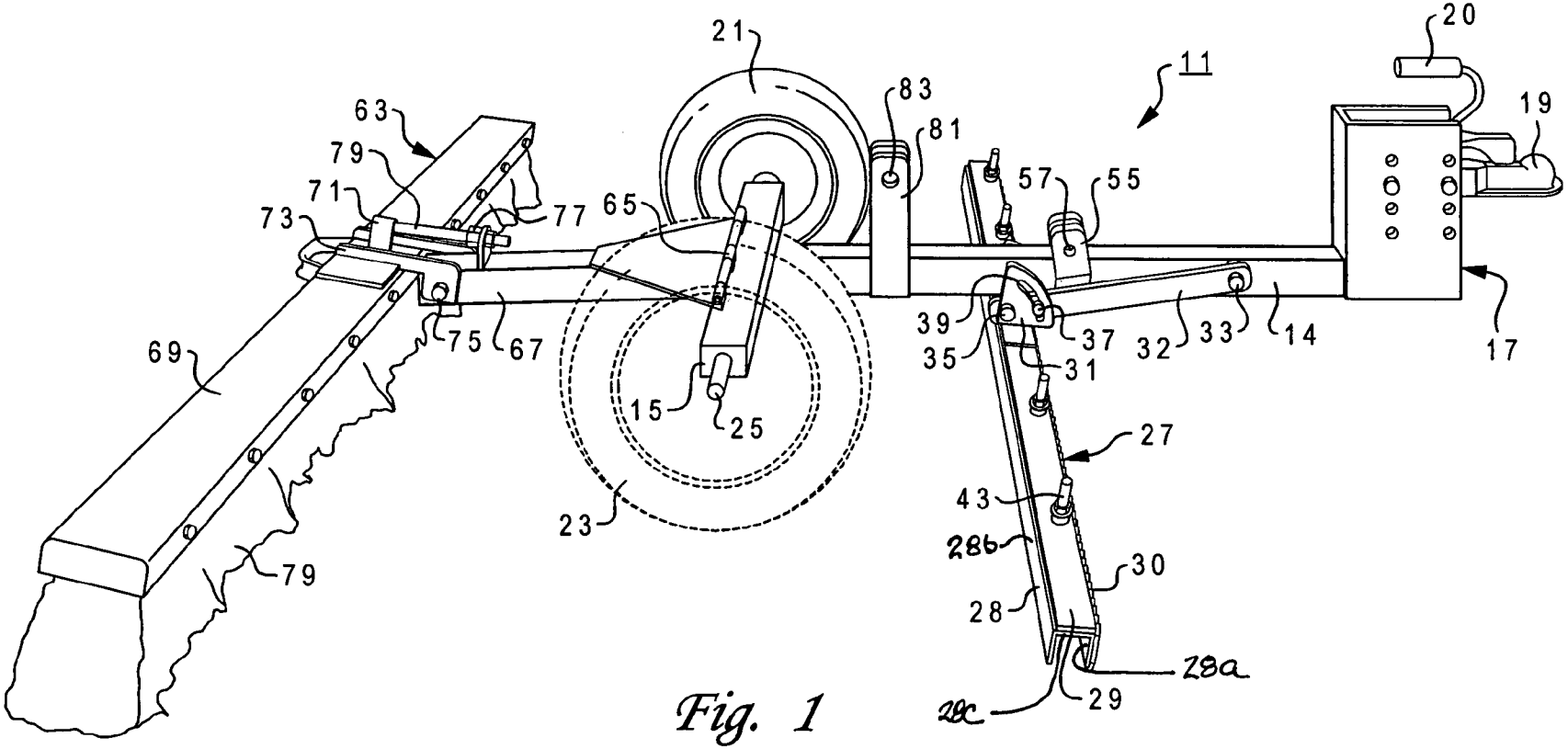
FIG. 1 is a perspective view of a grooming apparatus constructed according to the present invention, one of the wheel assemblies being shown in phantom.
Figures 2A, 2B:
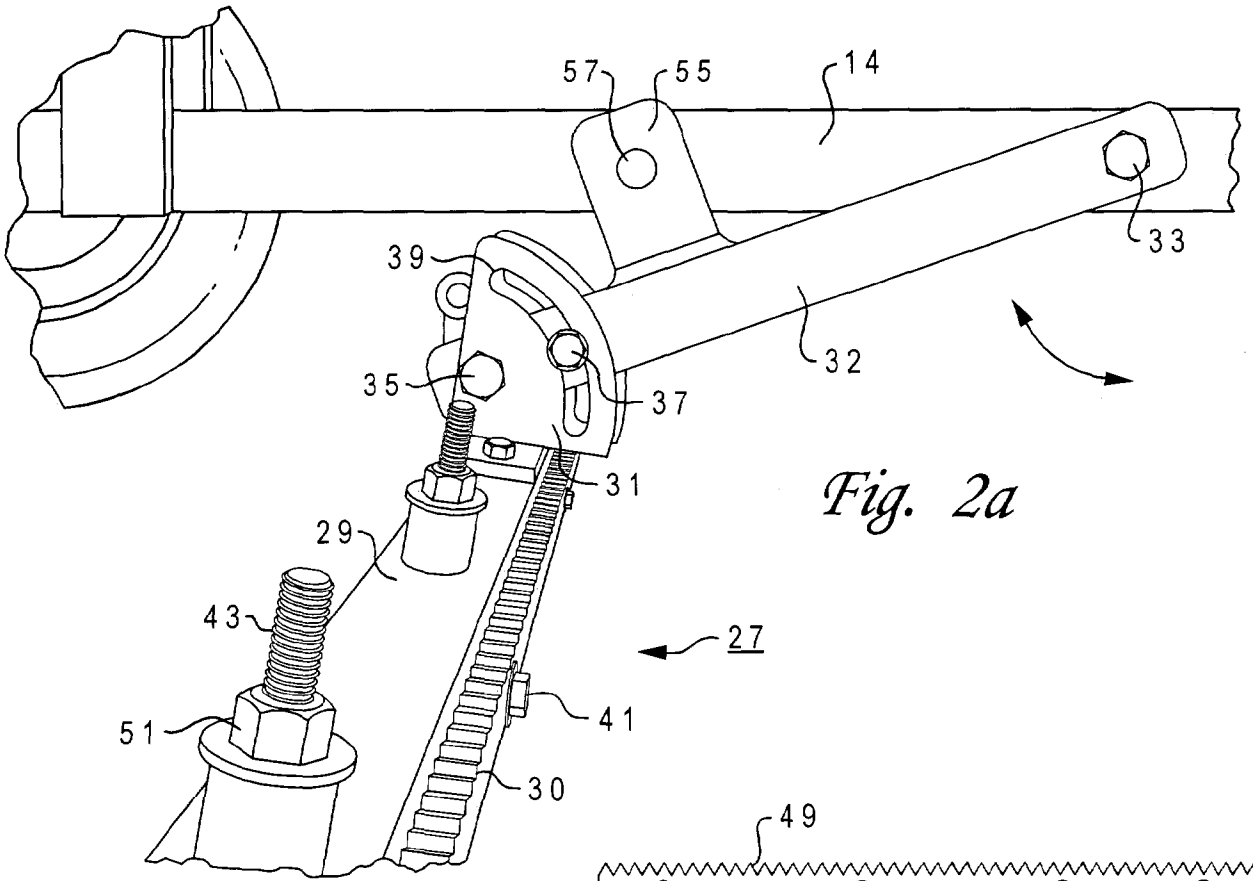
FIG. 2*a* is a perspective view showing detail of the tilt adjustment of the apparatus of FIG. 1.
FIG. 2*b* is a front view of a rake blade constructed according to the invention.
Figure 3:
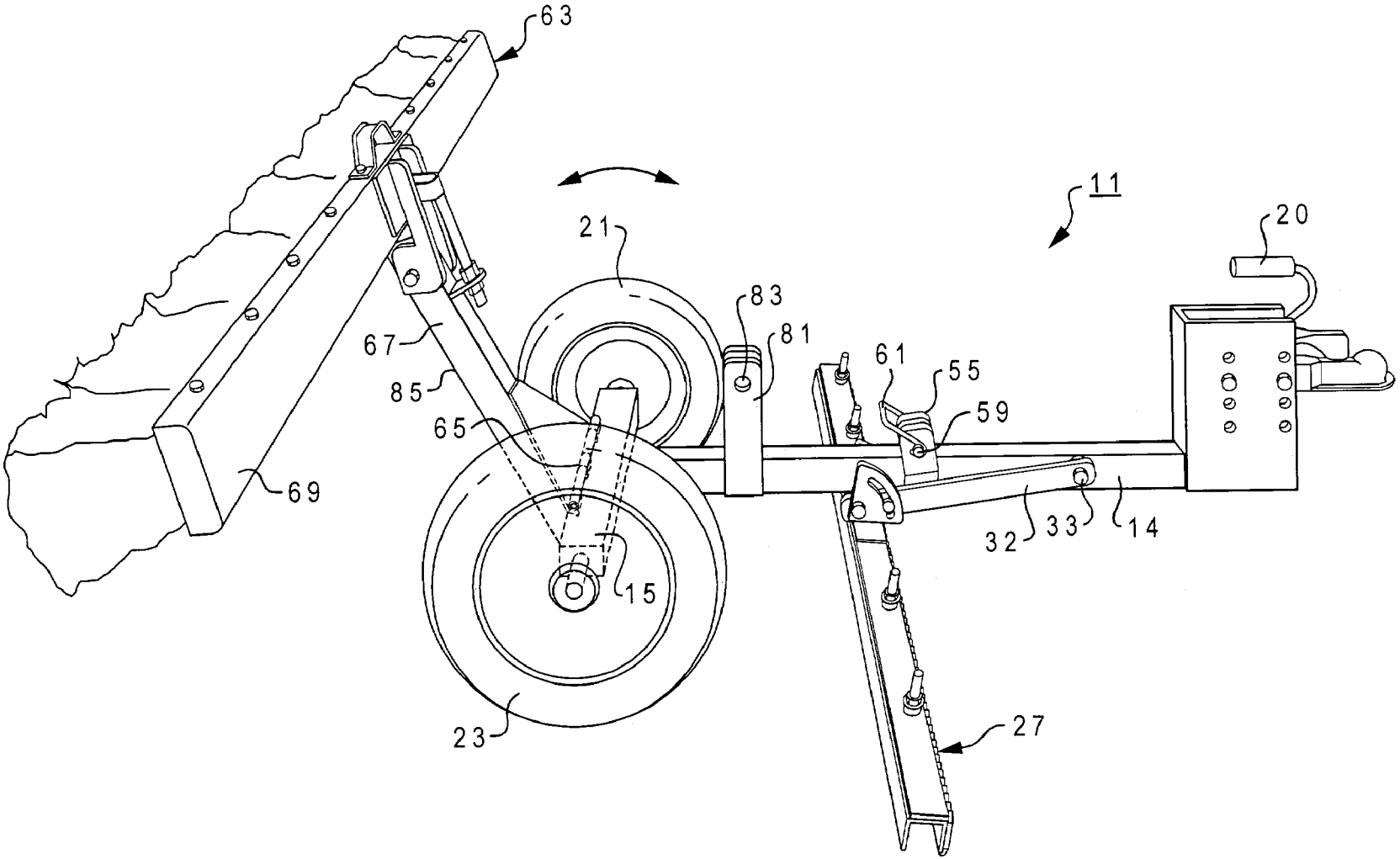
FIG. 3 is a perspective view of the apparatus of FIG. 1 partially configured for transportation or storage.
Figure 4:
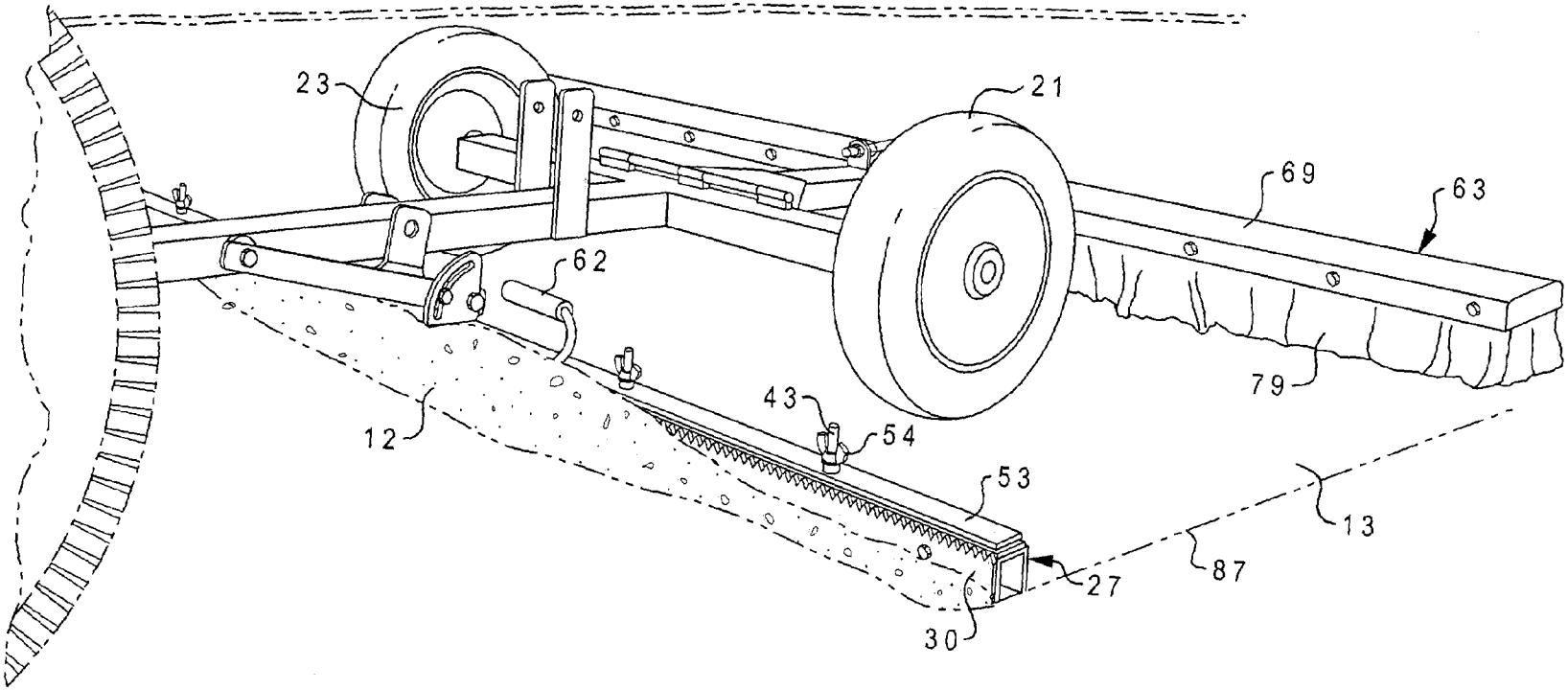
FIG. 4 is a perspective view showing the apparatus of FIG. 1 during use.

FIGS. 1 through 4 illustrate an apparatus 11 for grooming the soft earth or ground 12 (FIG. 4) on an athletic field, particularly the infield surface 13 of a baseball field. Apparatus 11 is preferably towed by a small tractor or similar vehicle, though apparatus 11 may alternatively be towed by hand. FIGS. 1, 2*a*, and 4 show apparatus 11 configured for use, whereas FIG. 3 shows apparatus 11 partially configured for transportation or storage.

Referring to the figures, apparatus 11 has a frame comprising a longitudinal beam or frame member 14 and a lateral or transverse frame member 15, members 14, 15 preferably being formed from rectangular metal tubing. Lateral member 15 is rigidly connected to the rear end of longitudinal member 14 to form a horizontal, T-shaped frame. Longitudinal member 14 has a tongue with a hitch assembly 17 on its forward end for pivotally connecting apparatus 11 to a tow vehicle (not shown). Hitch assembly 17 has a hitch 19 that is adjustable for height for connecting to the hitches of various tow vehicles or to change the angle of frame member 14 relative to infield surface 13. A handle 20 is located on hitch assembly 17, providing a grip for the user to use to lift the forward end of apparatus 11. Wheel assemblies 21, 23 are rotatably attached to a shaft 25 at each outer end of frame member 15 for supporting apparatus 11 above surface 13, wheel assembly 23 being shown in phantom in FIG. 1.

A rake assembly 27 is pivotally attached to a forward portion of frame member 14, rake assembly 27 being suspended below member 14. Assembly 27 pivots between an engaged or ground-engaging position, shown in FIGS. 1, 2*a*, and 4, and a retracted or storage position, shown in FIG. 3. Assembly 27 comprises a rake support bar 28, spacer plate 29, rake blade 30, and tilt plate 31. Support bar 28 is a downward facing open channel member having a forward plate 28*a*, a rearward plate 28*b* and a top plate 289*c* extending between plates 28*a*. 28*b*. Plates 28*a* and 28*b* are parallel to each other and perpendicular to top plate 28*c* in this embodiment. The lower edges of plates 28*a*, 28*b* are free and adapted to contact the ground. As shown in the figures and in detail in FIG. 2, assembly 27 is connected to frame member 14 by a pivot arm 32 on each lateral side of member 14. The forward end of each arm 32 pivots on shaft 33, and the rear end of each arm 32 is attached to assembly 27 by shaft 35. Arms 32 freely pivot about shaft 33, but assembly 27 is selectively held at a desired angle relative to arms 32 by bolt 37, which frictionally engages a slot 39 in tilt plate 31. By loosening bolt 37, assembly 27 may be rotated relative to arms 32 within the range limit defined by slot 39.

Referring to FIGS. 1, 2*a* and 2*b*, rake blade 30 is fastened by bolts 41 to forward plate 28*a* of support bar 28, and spacer plate 29 is fastened to top plate 28*c* of support bar 28 by bolts 43. As shown in FIG. 2*b*, blade 30 has a first row 45 of teeth, for raking earth 12 of infield 13 (FIG. 4), and vertically elongated holes 47, which have a width sized to receive bolts 41 for mounting blade 30 on support bar 28.

Blade 30 also has a second, oppositely arranged row 49 of teeth for allowing a user to invert and reinstall blade 30 when first row 45 is worn or damaged, second row 49 then being used to rake infield earth 12. Each of the teeth of rows 45, 49 has inclined side edges that converge to a peak, as shown in FIG. 2*b*. Blade 30 is preferably positioned on support bar 28 so that rows 45, 49 of teeth are parallel to the lower edge of support bar 28. Also, rake assembly 27 is preferably adjusted so that the height of blade 30 is perpendicular to surface 13. The lower of rows 45, 49 of teeth extends below the lower edge of forward plate 28*a* of support bar 28 for breaking up and raking earth 12 as apparatus 11 is towed. To adjust the effect of blade 30 on surface 13, the height of blade 30 relative to support bar 28 can be adjusted by loosening bolts 41, allowing blade 30 to be repositioned to the desired height or, if desired, the desired angle relative to support bar 28.

Referring again to the figures, the threaded portion of each bolt 43 extends upward, and bolts 43 are retained on rake assembly 27 by nuts 51. When necessary to break up hardened earth 12, weight plates 53 can be mounted on bolts 43, as shown in FIG. 4, to provide additional downward force on rake assembly 27. Plates 53 rest on nuts 51 and are preferably retained on bolts 43 by wing nuts 54. Plates 53 having different thickness and weights may be used to select the desired additional force, and multiple plates 53 may be used.

A plate 55 is mounted to the upper edge of each arm 32, each plate 55 having a hole 57 extending laterally through plate 55. Referring to FIG. 3, plates 55 and holes 57 are laterally aligned, and holes 57 are positioned to be above the upper surface of frame member 14 when in the retracted position, as shown. Pin 59 is inserted through holes 57 and above frame member 14 to support rake assembly 27 in the retracted position, clip 61 retaining pin 59 in holes 57. Pin 59 thus serves as a latch. When assembly 27 is in the engaged position, holes are below the upper surface of frame member 14, as best shown in FIGS. 2*a* and 4. A handle 62, visible in FIG. 4, is attached to rake assembly 27, providing a grip for the user to use in lifting and holding assembly 27 in the retracted position for insertion of pin 59.

A broom assembly 63 is pivotally attached to the rear of frame member 15 with hinge 65, assembly 63 comprising arm 67, bristle broom 69, and adjuster 71. Arm 67 extends rearward from hinge 65, and broom 69 is pivotally attached to a rear portion of arm 67 with bracket 73 and shaft 75. Bracket 73 pivots on shaft 75 to provide rotation of broom 69 relative to arm 67, adjuster 71 allowing the user to selectively adjust the angle of broom 69 by rotating nuts 77 on a threaded shaft 79. Changing the angle of broom 69 raises or lowers broom 69 relative to infield 13 for adjusting the effect of bristles 79 on infield earth 12 and to account for the angle of frame member 14 relative to infield 13. Broom 69 preferably engages infield 13 at an angle relative to infield 13, limiting bouncing of broom 69 during use and producing a desired aesthetic result.

In FIG. 3, broom assembly 63 is shown partially rotated toward a storage position, in which broom assembly 63 is rotated about hinge 65 to a position where arm 67 is located above frame member 14 and broom 69 is positioned generally above rake assembly 27. A plate 81 extends upward from each lateral side of frame member 14, plates 81 being located forward of frame member 15. Each plate 81 has a hole 83 sized to receive a pin (not shown, but like pin 59) for retaining broom assembly 63 in the storage position, the pin and holes 83 being located above surface 85 of arm 67. In the storage position broom assembly 63 will be forward of wheels 23. Because hinge 65 is located forward of the rear edge of wheel assemblies 21, 23, apparatus 11 may be stored against a vertical surface, such as a wall, when broom assembly 63 is in the storage position. In this stored position, apparatus 11 is rotated so that longitudinal frame member 14 is generally vertical, and wheel assemblies 21, 23 are moved to near or against the vertical surface.

Referring to the figures, prior to operation, a user adjusts height of hitch 19 in hitch assembly 17 to the desired or required height for the corresponding hitch portion on the tow vehicle. Rake blade 30 is fastened to support bar 28, blade 30 being positioned to provide a row 45, 49 of teeth with a selected penetration depth, rows 45, 49 typically being parallel to infield surface 13. The angle of rake assembly 27 to arms 32 is adjusted at tilt plate 31, rake assembly 27 preferably being used with the plane of the height of rake blade 30 perpendicular to surface 13. If desired, weight plates 53 (FIG. 4 may be added to rake assembly 27.

In operation, apparatus 11 is moved to a location for grooming, and one or both of rake assembly 27 and broom assembly 63 may be deployed for use in grooming. To deploy rake assembly 27, the user detaches clip 61 from pin 59, and then pulls upward on handle 62 and removes pin 59 from holes 57 in plates 55. Once pin 59 is removed, rake assembly 27 is free to move downward until blade 30 contacts infield surface 13. Arms 32 freely rotate on shaft 33 relative to frame member 14, allowing rake assembly 27 to move vertically to adjust for variation in the height of infield surface 13.

To deploy broom assembly 63, the user removes the pin (not shown) from holes 83 in plates 81 and rotates broom assembly 63 rearward about hinge 65. The height and angle of broom 69 relative to infield 13 are adjusted using adjuster 71, broom 69 and bracket 73 rotating about shaft 75.

As shown in FIG. 4, grooming is accomplished by towing apparatus 11 across infield 13. Blade 30 breaks up hardened earth 12 and rakes loose earth 12 in path 87 on infield 13, blade 30 typically forming a mound of earth 12 in front of rake assembly 27. Blade 30 cause earth 12 remaining in path 87 to be smooth and relatively flat, and then bristles 79 of broom 69 further smooth surface 13 along path 87. As mentioned above, apparatus 11 may be used with only rake assembly 27 or broom assembly 63 deployed, or apparatus may be used with assemblies 27, 63 both being deployed. After use, rake assembly 27 and broom assembly 63, are repositioned to their retracted or storage positions.

Figure 5:
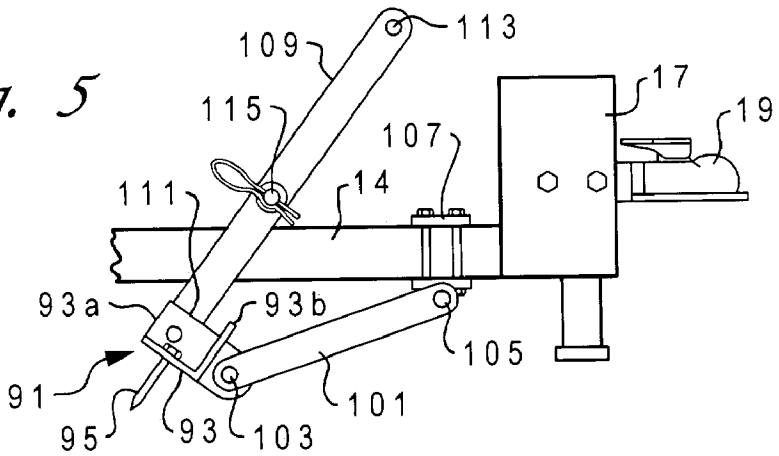
FIG. 5 is a partial sectional view, taken along the line 5—5 of FIG. 6, of an optional second rake bar for attachment with the apparatus of FIG. 1.
Figure 6:
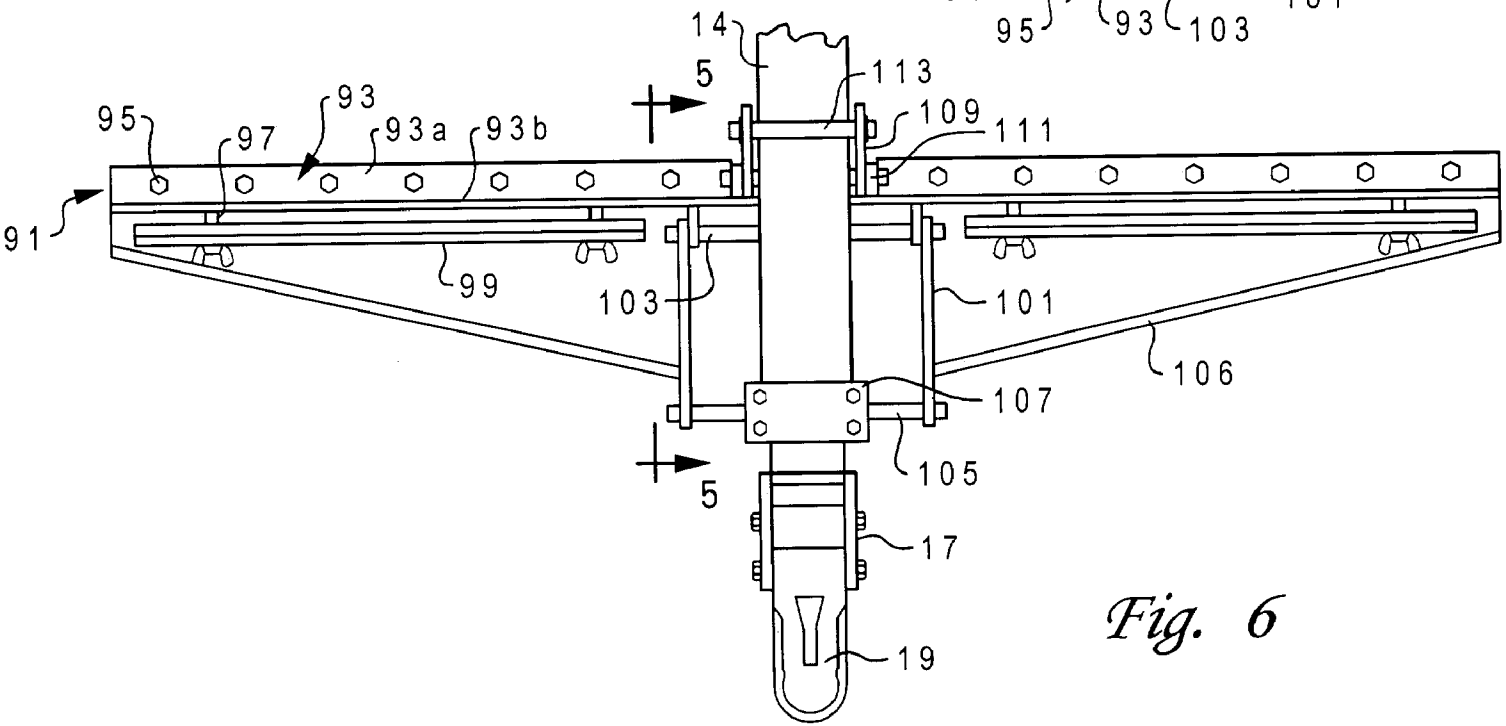
FIG. 6 is a top view of the second rake bar of FIG. 5.

FIGS. 5 and 6 show another rake bar 91 that is optionally mounted to frame member 14. Rake bar 91, if used, is preferably mounted to frame member 14 forward of rake assembly 27 although it could be used in place of rake assembly 27. Rake bar 91 has a support beam 93 that is a steel angle member with a first flange 93*a* and a second flange 93*b* at 90 degrees from each other. A plurality of tines 95 are secured to first flange 93*a* and protrude downward for tilling the soil. Tines 95 are spaced apart from each other along the length of support beam 93. Tines 95 are preferably threaded on their upper ends so as to be removable from support beam 93 for replacement. Each tine 95 has a sharp, pointed lower end, as illustrated in FIG. 5.

A plurality of bolts 97 protrudes through second flange 93*b* perpendicular to tines 95. A plurality of weight plates 99 are selectively mounted to bolts 97 and secured by wing nuts for applying weight to rake bar 91.

Rake bar 91 is secured to longitudinal frame member 14 by a pair of link bars 101. Each link bar 101 has a lower end pivotally secured to a lower support bar 103. Lower support bar 103 is rigidly mounted to second flange 93*b*. The upper ends of link bars 101 are pivotally secured to an upper support bar 105. Upper support bar 105 is parallel to lower support bar 103 and coupled to the lower side of frame member 14 by a bracket 107.

A pair of struts 106 extends diagonally from each link bar 101 near the upper end to each outer end of rake bar 91. Struts 106 are not shown in FIG. 5. Optionally, the relative angle between tines 95 and link bars 101 can be adjusted so as to select the precise orientation of tines 95 while in the ground engaging position. The adjustment is made at the bolted connections between the lower support bar 103 and link bars 101, and also at the bolted connections at the outer ends of struts 106 to the support beam 93. Alternately, rake bar 91 could be fixed to link bars 101 so that tines 95 are always vertical while in the ground engaging position.

Rake bar 91 is moved between the ground engaging position shown in FIG. 6 and the storage position shown in FIG. 5 by a pair of lift bars 109. Each lift bar 109 has a lower end pivotally secured to a lug 111 that is welded to the rearward side of second flange 93*b*. Lift bars 109 extend upward along each side of longitudinal frame member 14. A handle 113 extends between lift bars 109 at the upper end. A pin 115 may be selectively placed through aligned holes in lift bars 109 when rake bar 91 is lifted to the storage position. Pin 115 will engage the upper side of frame member 14 to hold rake bar 91 in the storage position.

Rake bar 91 is employed in the same manner as rake assembly 27. Rake bar 91 may be used in a ground engaging position at the same time that rake assembly 27 and broom assembly 63 are in a ground engaging position. Alternately, rake bar 91 could be in the storage position while rake assembly 27 is engaging the ground or vice versa. Rake assembly 27, broom assembly 63 and rake bar 91 are independently movable between their storage and ground engaging positions.

Several advantages are realized with the present invention. The apparatus provides an easy-to-use, towable grooming tool for use on baseball infields or similar surfaces. A rake blade is used to break up and rake the earth, and a broom smooths the earth remaining in the grooming path. The rake blade and broom cooperate to spread the earth evenly along the field. The extended width of the blade provides for improved removal of high spots, and the field is further leveled with each subsequent use. The apparatus provides for adjustment of blade depth, blade angle, and broom angle. The broom and rake assemblies are movable to retracted positions, reducing the space requirement for storage of the apparatus.

While the invention has been shown in only one of its forms, it should be apparent to those skilled in the art that it is not so limited, but is susceptible to various changes without departing from the scope of the invention.

We claim:

1. An apparatus for grooming ground, comprising:

a frame supported on a set of wheels at a rearward end and having a tongue on a forward end for attachment to a towing vehicle;

a rake bar for raking earth, the rake bar being pivotally mounted below and transverse to the frame between the forward and rearward ends, the rake bar being movable between a ground engaging position and a storage position that is beneath the frame and elevated relative to the ground engaging position;

a broom bar pivotally mounted to the rearward end of the frame by a broom bar arm and having a set of bristles for sweeping the ground, the broom bar and the broom bar arm being movable independently of the rake bar between a ground engaging position and a storage position; and wherein the broom bar is located entirely forward of the wheels transverse to a longitudinal axis of the frame and with the bristles facing away from the frame while in the storage position to enable the apparatus to be stored with the wheels resting on the ground and the frame tilted up to a substantially vertical position against a wall.

2. The apparatus according to claim 1, wherein:

the rake bar comprises a blade having a plurality of serrations for engaging the ground, each of the serrations having inclined edges that converge toward each other to a peak.

3. The apparatus according to claim 1, wherein:

the rake bar is mounted to the frame by rake bar arm having one end mounted to the frame at a pivot point and another end connected to the rake bar, so that rotating the rake bar arm about the pivot point moves the rake bar between the ground engaging and storage positions; and wherein the rake bar is pivotally mounted to the rake bar arm to selected various inclinations of the rake bar relative to the ground.

4. The apparatus according to claim 1, wherein the rake bar comprises:

a blade mounting bar; and a blade having serrations on oppositely facing first and second edges, the blade being selectively mounted on the blade mounting bar with the first edge positioned to engage the ground, and alternately with the second edge positioned to engage the ground.

5. The apparatus according to claim 1 wherein the rake bar comprises:

a downward facing channel member having forward and rearward sides joined by an upper side, each of the forward and rearward sides having a lower edge portion positioned for contact with the ground; and a blade having serrations and mounted on the forward side of the blade mounting bar with the serrations positioned slightly lower than the lower edge portion of the forward side to engage the ground.

6. The apparatus according to claim 1, wherein:

the broom bar is pivotally mounted to the broom bar arm to allow the broom bar to be positioned at various inclinations relative to the ground while in the ground engaging position.

7. The apparatus according to claim 1, further comprising:

a second rake bar pivotally mounted forward of the first-mentioned rake bar transverse to the frame, the second rake bar being movable relative to the frame independently of the first-mentioned rake bar between a ground engaging position and a storage position that is beneath the frame and elevated relative to the ground engaging position;

the second rake bar having a plurality of spaced apart tines for engaging the ground; and the first rake bar comprising a blade with a plurality of serrations.

8. An apparatus for grooming ground, comprising:

a frame having a tongue on a forward end for attaching to a towing vehicle, the frame having a longitudinal beam that is centered on the apparatus and a transverse beam on a rearward end of the longitudinal beam that is supported by a pair of wheels;

a rake bar for raking the ground;

a pair of rake bar arms mounted to the rake bar and pivotally secured to opposite sides of the longitudinal beam forward of the wheels, so that rotating the rake bar arms about the pivot point swings the rake bar upward from a ground engaging position to a storage position beneath the frame;

the rake bar comprising forward and rearward parallel supporting plates, each having a free lower edge for engaging the ground;

a blade mounted to the forward supporting plate and having serrations on a first edge that selectively extend below the lower edge of the forward supporting plate for engaging the ground;

a broom bar for sweeping the ground; and a broom bar arm secured to the broom bar and pivotally mounted to the transverse beam about a pivot point for dragging the broom bar behind the wheels while the broom bar is in a ground engaging position, wherein rotating the broom bar arm about the pivot point on the transverse beam places the broom bar in a storage position entirely forward of the wheels and above the longitudinal beam.

9. The apparatus according to claim 8, wherein the rake bar is pivotally and adjustably mounted to the rake bar arms to select various inclinations of the rake bar relative to the ground while in the ground engaging position.

10. The apparatus according to claim 8, wherein the broom bar is pivotally and adjustably mounted to the broom bar arm to select various inclinations of the broom bar relative to the ground while in the ground engaging position.

11. The apparatus according to claim 8, wherein the blade has serrations on a second that opposite the first edge, the blade being selectively mounted on the blade mounting bar with the first edge positioned to engage the ground, and alternately with the second edge positioned to engage the ground.

12. The apparatus according to claim 8, wherein each of the serrations has a pair of inclined edges that converge toward each other.

13. The apparatus according to claim 8, further comprising:

a second rake bar pivotally mounted forward of the first-mentioned rake bar transverse to the frame, the second rake bar being movable relative to the frame independently of the first-mentioned rake bar between a ground engaging position and a storage position that is beneath the frame and elevated relative to the ground engaging position, the second rake bar having a plurality of spaced apart tines for engaging the ground.

14. The apparatus according to claim 8, further comprising:

latch plates mounted to each of the rake arms, the latch plates being spaced apart slightly greater than a width of the longitudinal beam and protruding from the rake arms for location on opposite sides of the longitudinal beam while the rake bar is in the storage position; and a fastener that releasably extends through aligned holes in the latch plates for resting on an upper side of the longitudinal beam to retain the rake bar in the storage position.

15. An apparatus for grooming ground, comprising:

a frame supported on a set of wheels at a rearward end and having a tongue on a forward end for attachment to a towing vehicle;

a rake bar for raking earth, the rake bar being pivotally mounted below and transverse to the frame between the forward and rearward ends, the rake bar being movable relative to the frame between a ground engaging position and a storage position that is beneath the frame and elevated relative to the ground engaging position; the rake bar comprising:

a rectangular downward facing channel member having forward and rearward plates, each of the plates having a free lower edge for engaging the ground;

a blade mounted to the forward plate, the blade having a lower edge with serrations that protrudes slightly below the lower edge of the forward plate for engaging the ground; and a broom bar pivotally mounted to the rearward end of the frame by an arm for sweeping the ground, the broom and arm being movable independently of the rake bar between a ground engaging position and a storage position.

16. The apparatus according to claim 15 wherein each of the serrations has side edges that converge toward each other to a peak.

17. The apparatus according to claim 15, further comprising:

a second rake bar pivotally mounted forward of the first-mentioned rake bar transverse to the frame, the second rake bar being movable relative to the frame independently of the first-mentioned rake bar between a ground engaging position and a storage position that is beneath the frame and elevated relative to the ground engaging position, the second rake bar having a plurality of spaced apart tines for engaging the ground.

* * * * *